US009984629B2

(12) United States Patent
Wang

(10) Patent No.: US 9,984,629 B2
(45) Date of Patent: May 29, 2018

(54) PIXEL CIRCUIT AND DISPLAY DEVICE THAT SETS A DATA LINE TO A REFERENCE VOLTAGE TO REMOVE A RESIDUAL DATA VOLTAGE

(71) Applicant: BOE TECHNOLOGY GROUP CO., LTD., Beijing (CN)

(72) Inventor: Ying Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 215 days.

(21) Appl. No.: 14/434,663

(22) PCT Filed: Sep. 29, 2014

(86) PCT No.: PCT/CN2014/087753

§ 371 (c)(1),
(2) Date: Apr. 9, 2015

(87) PCT Pub. No.: WO2015/149492

PCT Pub. Date: Oct. 8, 2015

(65) Prior Publication Data

US 2016/0372048 A1 Dec. 22, 2016

(30) Foreign Application Priority Data

Apr. 2, 2014 (CN) ..... 2014 1 0132073

(51) Int. Cl.
*G09G 5/10* (2006.01)
*G09G 3/3283* (2016.01)
(Continued)

(52) U.S. Cl.
CPC ..... *G09G 3/3283* (2013.01); *G09G 3/2003* (2013.01); *G09G 3/3233* (2013.01);
(Continued)

(58) Field of Classification Search
None
See application file for complete search history.

(56) References Cited

U.S. PATENT DOCUMENTS

2004/0090434 A1 5/2004 Miyazawa
2004/0125308 A1* 7/2004 Park ..... G02F 1/136204 349/149
(Continued)

FOREIGN PATENT DOCUMENTS

CN 1278297 C 10/2006
CN 1917015 A 2/2007
(Continued)

OTHER PUBLICATIONS

Written Opinion of the International Searching Authority for international application No. PCT/CN2014/087753.

*Primary Examiner* — Ilana Spar
*Assistant Examiner* — Kirk Hermann
(74) *Attorney, Agent, or Firm* — Harness, Dickey & Pierce, P.L.C.

(57) ABSTRACT

A pixel circuit includes a pixel driving circuit and a display data inputting circuit configured to provide display data for the pixel driving circuit. The display data inputting circuit includes a gating inputting unit configured to, when a line scanning signal is valid, provide at different periods of time, red-color, green-color and blue-color display data for the pixel driving circuit through a data line connected with a resistor-capacitor unit in parallel. The display data inputting circuit further includes a data line setting unit configured to, after the gating inputting unit provides the red-color, the green-color or the blue-color display data for the pixel driving circuit through the data line, set a voltage of the data line to a reference voltage, so that residual display data in the data line is released by the resistor-capacitor unit; and a
(Continued)

voltage value of the reference voltage is less than a predetermined value.

12 Claims, 3 Drawing Sheets

(51) Int. Cl.

| | |
|---|---|
| ***G09G 3/3233*** | (2016.01) |
| ***G09G 3/3291*** | (2016.01) |
| ***G09G 3/20*** | (2006.01) |
| ***G09G 3/3266*** | (2016.01) |

(52) U.S. Cl.
CPC ..... *G09G 3/3266* (2013.01); *G09G 3/3291* (2013.01); *G09G 2300/0819* (2013.01); *G09G 2300/0852* (2013.01); *G09G 2300/0861* (2013.01); *G09G 2310/0297* (2013.01); *G09G 2320/0209* (2013.01)

(56) References Cited

U.S. PATENT DOCUMENTS

| | | | | |
|---|---|---|---|---|
| 2007/0040770 | A1* | 2/2007 | Kim | G09G 3/3233 345/76 |
| 2008/0062089 | A1* | 3/2008 | Kim | G09G 3/3275 345/76 |
| 2010/0302228 | A1 | 12/2010 | Ishiguro et al. | |
| 2014/0062989 | A1* | 3/2014 | Ebisuno | G09G 3/3241 345/212 |

FOREIGN PATENT DOCUMENTS

| | | | |
|---|---|---|---|
| CN | 101145318 | A | 3/2008 |
| CN | 101295463 | A | 10/2008 |
| CN | 102349098 | A | 2/2012 |
| CN | 103714776 | A | 4/2014 |
| CN | 103927987 | A | 7/2014 |
| CN | 203760053 | U | 8/2014 |
| JP | S-6273234 | A | 4/1987 |

* cited by examiner

PIXEL CIRCUIT AND DISPLAY DEVICE THAT SETS A DATA LINE TO A REFERENCE VOLTAGE TO REMOVE A RESIDUAL DATA VOLTAGE

CROSS-REFERENCE TO RELATED APPLICATIONS

This application is the U.S. national phase of PCT Application No. PCT/CN2014/087753 filed on Sep. 29, 2014, which claims a priority of the Chinese Patent Application No. 201410132073.6 filed on Apr. 2, 2014, the disclosures of which are incorporated in their entirety by reference herein.

TECHNICAL FIELD

The present disclosure relates to the field of display technology, in particular to a pixel circuit and a display device.

BACKGROUND

In a full color active matrix/organic light emitting diode (AMOLED) panel constituted by a red-color sub-pixel R, a green-color sub-pixel G and a blue-color sub-pixel B, a corresponding gating inputting circuit is required to be adopted in a backplane circuit, to realize a 1:3 switch gating in a data line. As shown in FIG. 1, the gating inputting circuit includes a first gating transistor TR, a second gating transistor TG and a third gating transistor TB. The first gating transistor TR has a gate electrode coupled with a red-color gating signal SR, a first electrode coupled with a pixel driving circuit through a date line Date, and a second electrode coupled with red-color display data Data_R. The second gating transistor TG has a gate electrode coupled with a green-color gating signal SG, a first electrode coupled with the pixel driving circuit through the date line Date, a second electrode coupled with green-color display data Data_G. The third gating transistor TB has a gate electrode coupled with a blue-color gating signal SB, a first electrode coupled with the pixel driving circuit through the date line Date, and a second electrode coupled with blue-color display data Data_B. The data line Data is connected with a resistor-capacitor unit RC in parallel. In FIG. 1, the TR, TG and TB employ p-type transistors (may also be replaced with n-type transistors in actual implementation).

Although adoption of the gating inputting circuit may reduce the number of pins in a driving chip and an area of the data lines in a fanout region of the backplane circuit, write time of each of three primary color RGB display data is also reduced to be ⅓ of a period of time during which one line scanning signal Gate is valid, as shown in FIG. 2, which gives a higher requirements to charging efficiency of the pixel circuit. The adoption of the gating inputting circuit may cause multiplexing of the data line and parasitic resistance and capacitance in the data line may cause delay of display signals, particularly a residual voltage in the data line may cause mutual crosstalk among the three primary color RGB display data, thus a gray level of displaying is affected.

SUMMARY

A main object of the present disclosure is to provide a pixel circuit and a display device which can avoid mutual crosstalk among three primary color RGB display data caused by a residual voltage in a data line.

In order to achieve the above object, the present disclosure provides a pixel circuit. including a pixel driving circuit and a display data inputting circuit configured to provide display data for the pixel driving circuit; wherein the display data inputting circuit includes a gating inputting unit;

the gating inputting unit is configured to, when a line scanning signal is valid, provide at different periods of time a red-color display data, green-color display data and blue-color display data for the pixel driving circuit through a data line; the data line is connected with a resistor-capacitor unit in parallel;

wherein the display data inputting circuit further includes:

a data line setting unit configured to, after the gating inputting unit provides the red-color display data, the green-color display data or the blue-color display data for the pixel driving circuit through the data line, set a voltage of the data line to a reference voltage, so that residual display data in the data line is released by the resistor-capacitor unit; and a voltage value of the reference voltage is less than a predetermined value.

Alternatively, the reference voltage is a zero voltage or negative voltage. Alternatively, the gating inputting unit includes:

a first gating transistor, a gate electrode of which is coupled with a red-color gating signal, a first electrode of which is coupled with the red-color display data and a second electrode of which is coupled with the data line;

a second gating transistor, a gate electrode of which is coupled with a green-color gating signal, a first electrode of which is coupled with the green-color display data and a second electrode of which is coupled with the data line; and a third gating transistor, a gate electrode of which is coupled with a blue-color gating signal, a first electrode of which is coupled with a blue-color display data and a second electrode of which is coupled with the data line;

when the line scanning signal is valid, the red-color gating signal, the green-color gating signal and the blue-color gating signal are valid at different periods of time; and there is an interval among a period of time during which the red-color gating signal is valid, a period of time during which the green-color gating signal is valid and a period of time during which the blue-color gating signal is valid.

Alternatively, the data line setting unit includes:

a reference voltage inputting transistor, a gate electrode of which is coupled with a control signal, a first electrode of which is coupled with the reference voltage and a second electrode of which is coupled with the data line;

wherein the control signal is in reverse phase with a gating signal formed by superposition of the red-color gating signal, the green-color gating signal and the blue-color gating signal.

Alternatively, the pixel driving circuit includes:

a driving transistor, a first electrode of which is coupled with a driving voltage;

a storage capacitor, a first terminal of which is coupled with the driving voltage and a second terminal of which is coupled with the gate electrode of the driving transistor;

a potential maintenance capacitor, a first terminal of which is coupled with a first electrode of an inputting transistor and a second terminal of which is coupled with a gate electrode of the driving transistor;

the inputting transistor, the gate electrode of which is coupled with the line scanning signal, a first electrode of which is coupled with the gate electrode of the driving transistor through the potential maintenance capacitor, and a second electrode of which is coupled with the data line; and an emission control transistor, a gate electrode of which is coupled with an emission control signal, a first electrode of which is coupled with a second electrode of the driving transistor and a second electrode of which is coupled with an emission component.

Alternatively, the emission component is an organic light emitting diode (OLED); an anode of the OLED is coupled with the second electrode of the emission control transistor, and a cathode of the OLED is coupled with another driving voltage.

Alternatively, the pixel driving circuit further includes a compensation transistor, a gate electrode of which is coupled with the line scanning signal, a first electrode of which is coupled with the gate electrode of the driving transistor and a second electrode of which is coupled with the second electrode of the driving transistor.

Alternatively, the pixel driving circuit further includes a reset transistor, a gate electrode of which is coupled with a reset signal, a first electrode of which is coupled with the gate electrode of the driving transistor and a second electrode of which is coupled with an initial voltage.

Alternatively, the transistors are P-type transistors or N-type transistors.

Alternatively, the initial voltage is grounded.

Alternatively, when there is a voltage drop caused by wire resistance or parasitic resistance in a driving power supply line which generates the driving voltage, a value of the initial voltage is adjusted so that the initial voltage offsets the voltage drop.

The present disclosure further provides a display device including the above pixel circuit.

Alternatively, the display device is an active-matrix organic light-emitting diode (AMOLED) display device.

Comparing with the related art, the present disclosure uses the data line setting unit to reset the voltage of the data line to the reference voltage after inputting the red-color display data, the green-color display data or the blue-color display data, so that the residual display data in the data line may be released by the resistor-capacitor unit to avoid mutual crosstalk among three primary colors R, G, B display data caused by a residual voltage in the data line.

DETAILED DESCRIPTION

The technical solutions of embodiments of the present disclosure will be described hereinafter in a clear and complete manner in conjunction with drawings of the embodiments of the present disclosure. Obviously, the described embodiments are merely some rather than all of, the embodiments of the present disclosure. Based on these embodiments of the present disclosure, a person skilled in the art may obtain other embodiments without creative work, which also fall within the scope of the present disclosure.

Transistors adopted in all embodiments of the present disclosure may be thin film transistors, field effect transistors, or other devices having same characteristics. In embodiments of the present disclosure, in order to distinguish two electrodes of a transistor in addition to a gate electrode, one electrode of the two is referred to as "source electrode" and the other electrode is referred to as "drain electrode". In addition, transistors may be divided into N-type transistors and P-type transistors according to characteristics of the transistors. In a driving circuit provided in one embodiment of the present disclosure, all transistors being P-type transistors is taken as an example for illustration, it can be conceivable that a person skilled in the art easily thinks of using N-type transistors without creative work, which also fall within the scope of the present disclosure.

Figure 1:
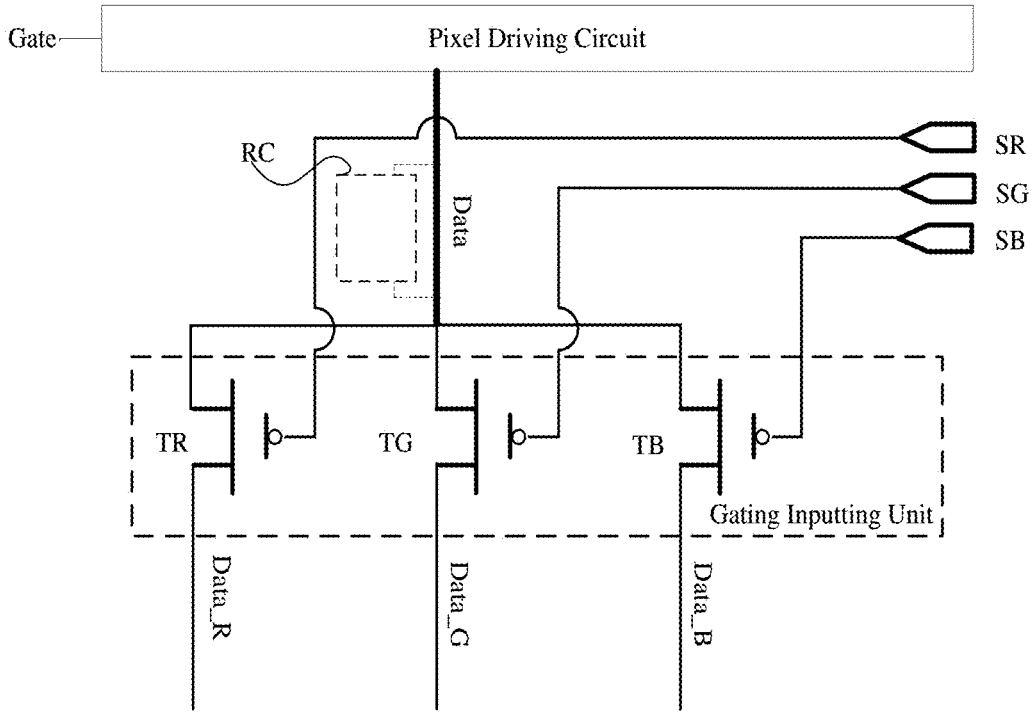
FIG. 1 is a schematic diagram of an existing pixel circuit.
Figure 2:
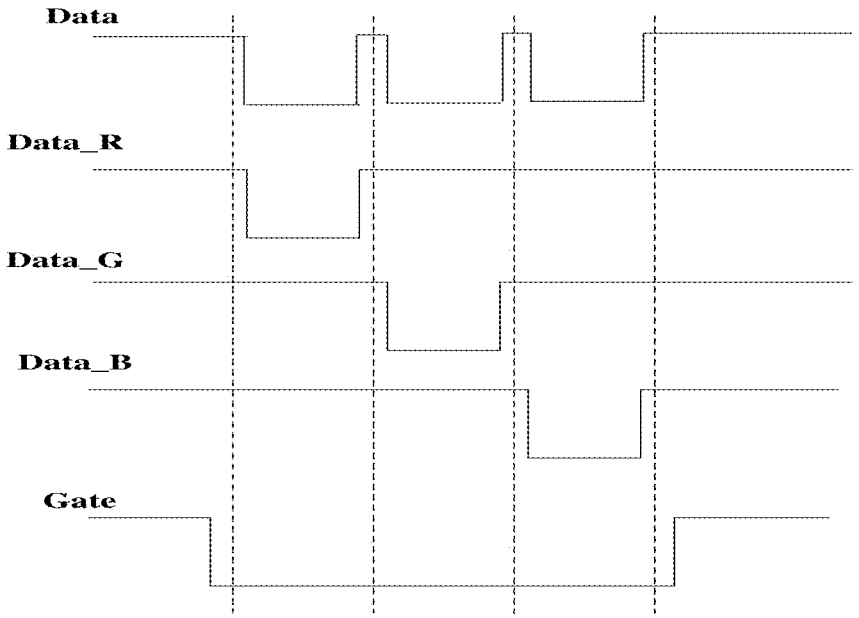
FIG. 2 is a diagram showing a timing sequence of signals of the existing pixel circuit.
Figure 3:
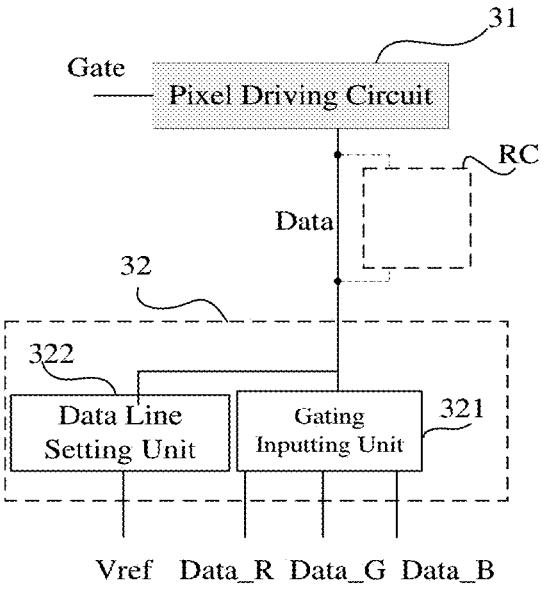
FIG. 3 is a block diagram of a pixel circuit according to one embodiment of the present disclosure.

As shown in FIG. 3, a pixel circuit of one embodiment of the present disclosure includes a pixel driving circuit 31 and a display data inputting circuit 32 configured to provide display data for the pixel driving circuit 31. The display data inputting circuit 32 includes a gating inputting unit 321.

The pixel driving circuit 31 is coupled with a line scanning signal Gate.

The gating inputting unit 321 is configured to, when the line scanning signal Gate is valid (which means to be at a low potential in this embodiment, the same hereinafter), provide at different periods of time red-color display data Data_R, green-color display data Data_G and blue-color display data Data_B for the pixel driving circuit 31 through a data line Data. The data line Data is connected with a resistor-capacitor unit RC in parallel.

The display data inputting circuit 32 further includes a data line setting unit 322 configured to, after the gating inputting unit 321 provides the red-color display data Data_R, the green-color display data Data_G or the blue-color display data Data_B for the pixel driving circuit 31 through the data line Data, set a voltage of the data line Data to a reference voltage Vref, so that residual display data in the data line Data may be released by the resistor-capacitor unit RC. A voltage value of the reference voltage Vref is less than a predetermined value.

The pixel circuit of one embodiment of the present disclosure uses the data line setting unit to reset the voltage of the data line to the reference voltage after inputting the red-color display data, the green-color display data or the blue-color display data, so that the residual display data in the data line may be released by the resistor-capacitor unit to avoid mutual crosstalk among three primary colors R, G, B display data caused by a residual voltage in the data line. The voltage value of the reference voltage is less than a voltage value of the residual display data in the data line. In actual operation, the reference voltage may be a zero voltage or negative voltage.

Figure 4:
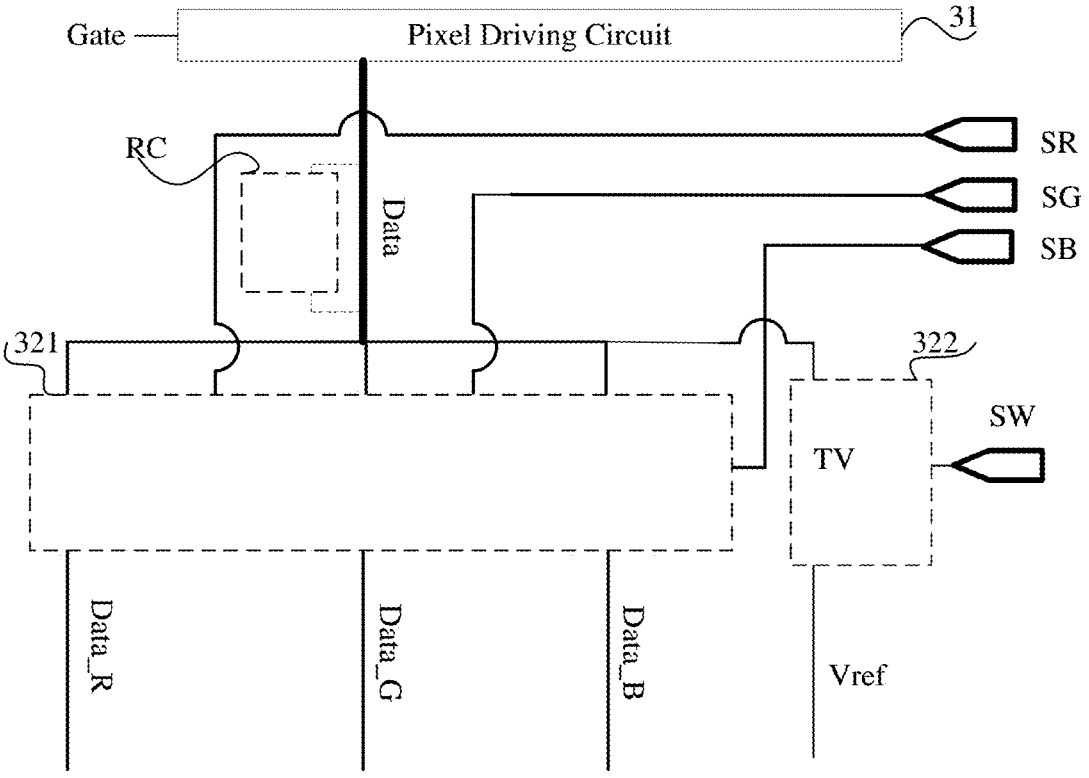
FIG. 4 is a block diagram of a pixel circuit according to another embodiment of the present disclosure.

Specifically, as shown in FIG. 4, the gating inputting unit 321 includes:

a first gating transistor TR, a gate electrode of which is coupled with a red-color gating signal SR, a first electrode of which is coupled with the red-color display data Data_R and a second electrode of which is coupled with the data line Data;

a second gating transistor TG, a gate electrode of which is coupled with a green-color gating signal SG, a first electrode of which is coupled with the green-color display data Data_G and a second electrode of which is coupled with the data line Data;

and a third gating transistor TB, a gate electrode of which is coupled with a blue-color gating signal SB, a first electrode of which is coupled with a blue-color display data Data_B and a second electrode of which is coupled with the data line Data;

when the line scanning signal Gate is valid, the red-color gating signal SR, the green-color gating signal SG and the blue-color gating signal SB are valid at different periods of time. There is an interval among a period of time during which the red-color gating signal SR is valid, a period of time during which the green-color gating signal SG is valid and a period of time during which the blue-color gating signal SB is valid.

The data line setting unit 322 includes:

a reference voltage inputting transistor TV, a gate electrode of which is coupled with a control signal SW, a first electrode of which is coupled with the reference voltage Vref and a second electrode of which is coupled with the data line Data.

The control signal SW is in reverse phase with a gating signal formed by superposition of the red-color gating signal SR, the green-color gating signal SG and the blue-color gating signal SB.

Figure 5:
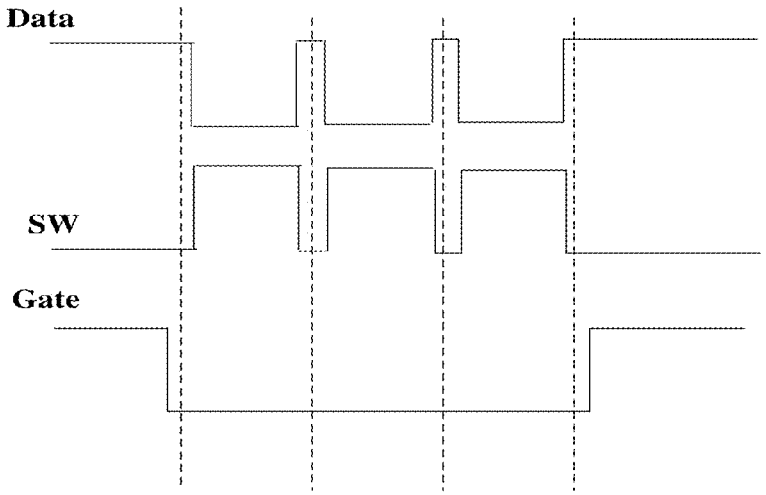
FIG. 5 is a diagram showing a work timing sequence of the pixel circuit according to one embodiment of the present disclosure.

FIG. 5 is a diagram showing timing sequences of the display data in the data line Date, the control signal SW and the line scanning signal Gate.

Figure 6:
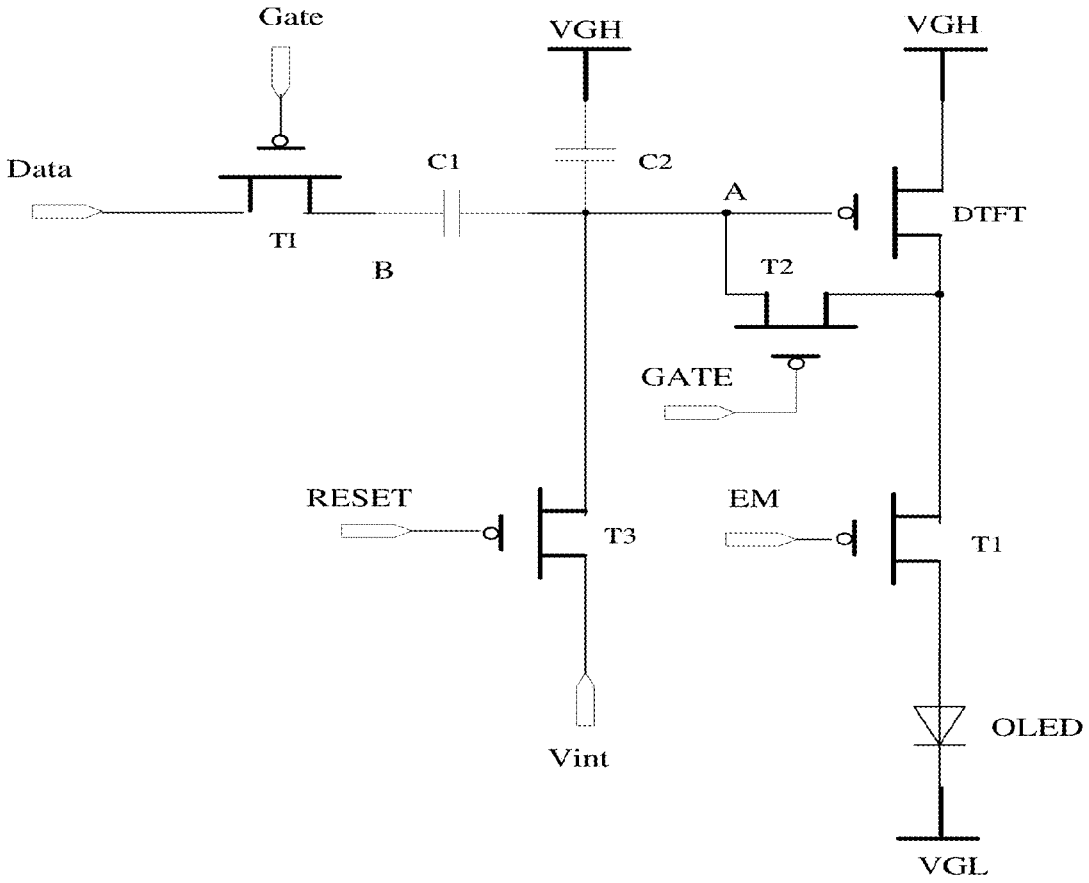
FIG. 6 is a circuit diagram of a pixel circuit according to still another embodiment of the present disclosure.

Specifically, as shown in FIG. 6, in the pixel circuit of one embodiment of the present disclosure, the pixel driving circuit includes:

a driving transistor DTFT, a first electrode of which is coupled with a first driving voltage VGH;

a potential maintenance capacitor C1, a first terminal of which is coupled with a first electrode of an inputting transistor TI and a second terminal of which is coupled with a gate electrode of the driving transistor DTFT;

a storage capacitor C2, a first terminal of which is coupled with the first driving voltage VGH and a second terminal of which is coupled with the gate electrode of the driving transistor DTFT;

the inputting transistor TI, the gate electrode of which is coupled with the line scanning signal Gate, a first electrode of which is coupled with the gate electrode of the driving transistor DTFT through the potential maintenance capacitor C1, and a second electrode of which is coupled with the data line Date;

an emission control transistor T1, a gate electrode of which is coupled with an emission control signal EM, a first electrode of which is coupled with a second electrode of the driving transistor DIFT and a second electrode of which is coupled with an emission component.

The emission component is an organic light emitting diode (OLED); the second electrode of the T1 is coupled with an anode of the OLED, and a cathode of the OLED is coupled with a second driving voltage VGL.

Alternatively, the pixel driving circuit may further include a compensation transistor T2, a gate electrode of which is coupled with the line scanning signal Gate, a first electrode of which is coupled with the gate electrode of the driving transistor DTFT, and a second electrode of which is coupled with the second electrode of the driving transistor DTFT.

Alternatively, the pixel driving circuit may further include a reset transistor T3, a gate electrode of which is coupled with a reset signal RESET, a first electrode of which is coupled with the gate electrode of the driving transistor DTFT and a second electrode of which is coupled with an initial voltage Vint.

In the pixel circuit of the embodiment shown in FIG. 6, all the transistors are P-type TFT; in actual operation, all or some of the transistors may be replaced with N-type transistors.

In the pixel circuit of the embodiment shown in FIG. 6, the driving transistor DTFT and the compensation transistor T2 form a diode connection so as to realize sampling and maintaining of a threshold voltage of the driving transistor DTFT, thereby realizing compensation effect.

Work states of the pixel circuit of the embodiment shown in FIG. 6 may be divided into an initialization stage t1, a data writing stage t2 and an OLED lighting stage t3.

In the initialization stage t1, the reset signal RESET is valid, the reset transistor T3 is turned on, the initial voltage Vint is written into a point A (a node coupled with the gate electrode of the driving transistor DTFT); at this time, a voltage which is at a right side of the capacitor C1 and is at a lower side of the capacitor C2 is also the initial voltage Vint, then an initialization of pixel states is completed.

In the data writing stage t2, the reset signal RESET jumps to a high potential, the reset transistor T3 is turned off, the initial voltage Vint is maintained by the capacitor C2. Meanwhile, the line scanning signal Gate is valid, a potential of the line scanning signal Gate is Vgate, then the emission control transistor T1 turns on, display data having a potential of Vdata is written into the pixel circuit through the data line Data, then at this time, a potential of the point A is (Vdata+Vint+Vgate). Meanwhile, since the line scanning signal Gate is valid, the compensation transistor T2 is turned on, then the gate electrode and the drain electrode of the driving transistor DTFT are connected to form a diode connection at this time. In order to facilitate the description, in this embodiment, the first electrode of the driving transistor DTFT is the source electrode, and the second electrode of the driving transistor DTFT is the drain electrode. At this time, the threshold voltage Vth of the driving transistor DTFT is recorded and maintained by the capacitor C2; the potential of the point A, i.e., the potential of the gate electrode of the driving transistor DTFT, is (Vdata+Vint+Vgate−Vth) and is stored in the capacitor C2. In this stage, the emission control signal EM is of a high potential to ensure that the emission control transistor T1 is turned off. And such an action of writing data into pixels does not affect light emitting state of the organic light-emitting diode (OLED), thereby avoiding flashing of display. Meanwhile, the emission control signal EM is of a high potential to ensure that the emission control transistor T1 is turned off, so as to ensure that the drain electrode of the driving transistor DTFT is disconnected from the second driving voltage VGL, thereby avoiding an adverse affect that a gate electrode voltage of the driving transistor DTFT is indirectly affected due to leakage current of the driving transistor DTFT. The reason for the adverse affect is that the leakage current between the source-drain electrodes of the driving transistor DTFT is directly introduced to the gate electrode terminal due to the presence of the diode connection, and then affects a drain current of the driving transistor DTFT, i.e., a driving current for the OLED. On other hand, in order to avoid a floating of the drain electrode of the driving transistor DTFT, the compensation transistor T2 is turned on under control of the line scanning signal Gate, and a voltage at the point A is introduced to the drain electrode of the DTFT, then even if the leakage current phenomenon occurs in the driving transistor DTFT, it does not affect a gate voltage of the driving transistor DTFT and the drain current of the driving transistor DTFT.

In the OLED lighting stage t3, the line scanning signal Gate jumps to a high level, the transistor TI and T2 are turned off, the voltage (Vdata+Vint+Vgate−Vth) of the point A is maintained by the capacitor C2, that is, the gate voltage of the driving transistor DTFT ensures that the driving transistor DTFT works in a saturation region. As this time, a current value of the drain current of the driving transistor DTFT has nothing to do with the threshold voltage Vth of the driving transistor DTFT, then a drifting of the threshold voltage Vth of the driving transistor DTFT does not affect the drain current of the driving transistor DTFT, i.e., the driving current for the pixel circuit. Meanwhile, the emission control signal EM is valid at this time, the emission control transistor T1 is turned on, the driving current of the pixel circuit flows through the emission control transistor T1 into the OLED, and lights up the OLED to display.

In addition, the initial voltage Vint may be selectively to be grounded, to play a role of resetting the potential of the point A. Alternatively, when there is a voltage drop caused by wire resistance or parasitic resistance in a driving power supply line which generates the first driving voltage VGH, then the value of the initial voltage Vint may be adjusted so that the initial voltage Vint may offset the voltage drop. At this time, the pixel circuit may solve the problem of pixel current fluctuations caused by the voltage drop of the driving power supply.

The present disclosure further provides a display device including the above pixel circuit.

Preferably, the display device is an active-matrix organic light-emitting diode (AMOLED) display device.

The above descriptions are merely intended to illustrate but not limit the present disclosure. It should be appreciated that, a person skilled in the art may make further modifications, variations or equivalent arrangements without departing from the spirit and scope defined by appended claims. Therefore, all the modifications, variations or equivalent arrangements may fall within the scope of the present disclosure.

What is claimed is:

1. A pixel circuit, comprising:

a pixel driving circuit and a display data inputting circuit configured to provide display data for the pixel driving circuit;

wherein the display data inputting circuit comprises a gating inputting unit;

the gating inputting unit configured to, when a line scanning signal is valid, provide at different periods of time a red-color display data, green-color display data, and blue-color display data for the pixel driving circuit through a data line; the data line connected with a resistor-capacitor unit in parallel;

wherein the display data inputting circuit further comprises:

a data line setting unit configured to, after the gating inputting unit provides the red-color display data, the green-color display data, or the blue-color display data for the pixel driving circuit through the data line, set a voltage of the data line to a reference voltage so that residual display data in the data line is released by the resistor-capacitor unit wherein a voltage value of the reference voltage is less than a predetermined value wherein the pixel driving circuit comprises:

a driving transistor including a first electrode that is coupled to a driving voltage;

a storage capacitor including a first terminal and a second terminal, the first terminal coupled to the driving voltage and the second terminal coupled to a gate electrode of the driving transistor;

a potential maintenance capacitor including a first terminal and a second terminal, the first terminal directly connected to a first electrode of an inputting transistor and the second terminal directly connected to the gate electrode of the driving transistor;

the inputting transistor including a gate electrode, the first electrode, and a second electrode, the gate electrode directly connected to the line scanning signal, the first electrode directly connected to the gate electrode of the driving transistor by way of the potential maintenance capacitor, and the second electrode directly connected to the data line; and an emission control transistor including a gate electrode, a first electrode, and a second electrode, the gate electrode directly connected to an emission control signal, the first electrode directly connected with a second electrode of the driving transistor, and the second electrode directly connected to an emission component, the first electrode of each transistor comprising at least one of a source electrode or a drain electrode of the respective transistor, and the second electrode of each transistor comprising the other one of the source electrode or the drain electrode of the respective transistor.

2. The pixel circuit according to claim 1, wherein the gating inputting unit comprises:

a first gating transistor including a gate electrode, a first electrode, and a second electrode, the gate electrode coupled to a red-color gating signal, the first electrode coupled to the red-color display data, and the second electrode coupled to the data line;

a second gating transistor including a gate electrode, a first electrode, and a second electrode, the gate electrode coupled to a green-color gating signal, the first electrode coupled to the green-color display data, and the second electrode coupled to the data line; and a third gating transistor including a gate electrode, a first electrode, and a second electrode, the gate electrode coupled to a blue-color gating signal, the first electrode coupled to the blue-color display data, and the second electrode coupled to the data line;

when the line scanning signal is valid, the red-color gating signal, the green-color gating signal, and the blue-color gating signal are valid at different periods of time; and there is an interval among a period of time during which the red-color gating signal is valid, a period of time during which the green-color gating signal is valid and a period of time during which the blue-color gating signal is valid.

3. The pixel circuit according to claim 2, wherein the data line setting unit comprises:

a reference voltage inputting transistor including a gate electrode, a first electrode, and a second electrode, the gate electrode coupled to a control signal, the first electrode coupled to the reference voltage, and the second electrode coupled to the data line;

wherein the control signal is in a reverse phase with a gating signal formed by superposition of the red-color gating signal, the green-color gating signal, and the blue-color gating signal.

4. The pixel circuit according to claim 2, wherein the transistors are P-type transistors or N-type transistors.

5. The pixel circuit according to claim 1, wherein the emission component is an organic light emitting diode (OLED) including an anode and a cathode; the anode of the OLED coupled to the second electrode of the emission control transistor, and the cathode of the OLED is coupled with another driving voltage.

6. The pixel circuit according to claim 1, wherein the pixel driving circuit further comprises a compensation transistor including a gate electrode, a first electrode, and a second electrode, the gate electrode coupled to the line scanning signal, the first electrode coupled to the gate electrode of the driving transistor, and the second electrode coupled to the second electrode of the driving transistor.

7. The pixel circuit according to claim 6, wherein the pixel driving circuit further comprises a reset transistor including a gate electrode, a first electrode, and a second electrode, the gate electrode coupled to a reset signal, the first electrode coupled to the gate electrode of the driving transistor, and the second electrode coupled to an initial voltage.

8. The pixel circuit according to claim 7, wherein the initial voltage is grounded.

9. The pixel circuit according to claim 7, wherein when there is a voltage drop caused by at least one of wire resistance or parasitic resistance in a driving power supply line that generates the driving voltage, a value of the initial voltage is adjusted so that the initial voltage offsets the voltage drop.

10. The pixel circuit according to claim 1, wherein the reference voltage is a zero voltage or a negative voltage.

11. A display device comprising the pixel circuit according to claim 1.

12. The display device according to claim 11, wherein the display device is an active-matrix organic light-emitting diode (AMOLED) display device.

* * * * *